US005078287A

United States Patent [19]

Holmes, III

[11] Patent Number: 5,078,287

[45] Date of Patent: Jan. 7, 1992

[54] VARIABLE SIZE NURSING BOTTLE

[76] Inventor: Wendell R. Holmes, III, 700 Robins Station Rd., North Huntington, Pa. 15642

[21] Appl. No.: 627,952

[22] Filed: Dec. 17, 1990

[51] Int. Cl.[5] ..... A61J 9/00

[52] U.S. Cl. ..... 215/11.1; 215/11.6; 220/8

[58] Field of Search ..... 215/11.1, 11.3, 11.6, 215/6; 220/8

[56] References Cited

U.S. PATENT DOCUMENTS

| | | | |
|---|---|---|---|
| 985,328 | 2/1911 | Decker | 215/11.3 X |
| 2,208,360 | 7/1940 | Duerme | 215/11.5 |
| 2,780,378 | 2/1957 | Romano | 215/11.1 |
| 2,853,209 | 9/1958 | McArdle | 215/11.1 X |
| 3,093,256 | 6/1963 | Woodbury, Jr. | 215/11.1 |
| 3,514,008 | 5/1970 | Dorn | 215/6 X |
| 3,651,973 | 3/1972 | Yamauchi | 215/11.3 |
| 3,718,140 | 2/1973 | Yamauchi | 215/11.1 |
| 4,010,861 | 3/1977 | Welten | 215/11.5 |
| 4,730,744 | 3/1988 | Vincguerra | 215/11.5 |
| 4,813,556 | 3/1989 | Lawrence | 215/11.1 X |

*Primary Examiner*—Sue A. Weaver

[57] ABSTRACT

A nursing bottle that can be adjusted in size so as to reduce the vacant space within the bottle; the aim is to prevent a vacuum from forming in the bottle. The bottle includes a cup-shaped liner that is telescopically slidable within a tubular sleeve. A circumferential rib on the liner has snap-fit engagement with selected grooves in the sleeve wall for determining the effective size of the bottle.

2 Claims, 1 Drawing Sheet

VARIABLE SIZE NURSING BOTTLE

BACKGROUND AND SUMMARY OF THE INVENTION

This invention relates to a variable size baby bottle construction. By adjusting the size of the bottle in accordance with the volume of liquid in the bottle it is possible to minimize the possibility of a vacuum developing within the bottle during the course of a baby feeding operation.

The presence of a vacuum condition within a nursing bottle can adversely affect the baby feeding process because the walls of the nipple at the mouth of the bottle then tend to close together so as to restrict the liquid flow. Also, it becomes more difficult for the baby to suck liquid out of the bottle because the vacuum tends to retain liquid within the bottle; the baby has to suck harder to extract the liquid. There have been prior art efforts to eliminate the undesired vacuum condition. U.S. Pat. No. 4,010,861 issued to O. Welten, shows a tubular baby bottle having an air-admission valve in its end wall; a piston is slidably arranged within the tubular bottle to reduce the bottle volume as liquid is sucked out of the bottle. Apparently the intent is to have a freely slidably piston that will respond to pressure differences thereacross by moving to equalize the pressure difference.

U.S. Pat. No. 4,730,744 issued to M. Vinciguerra shows a baby bottle having a spring-biased air valve in its end wall. Vacuum conditions within the bottle tend to open the valve for admitting air into the bottle, thereby tending to overcome the vacuum condition.

U.S. Pat. No. 2,208,360 to F. Deuerme shows a baby bottle having a flexible balloon structure extending from the bottle end wall into the space circumscribed by the bottle. As liquid is extracted from the bottle the negative pressure surrounding the balloon allows atmospheric pressure to expand the balloon into the bottle, thereby returning the liquid space to near atmospheric pressure.

The present invention contemplates a variable size nursing bottle that comprises a tubular sleeve, and a cup-shaped liner slidably telescoped into the sleeve. Circumferential grooves are formed in the sleeve at axially-spaced points therealong. A mating circumferential rib is formed on the liner near its mouth, such that manual motion of the liner into the sleeve enables the rib to have a snap fit in a selected one of the grooves. As the baby extracts liquid from the bottle the mother manually slides the liner into the bottle so that the rib snaps into the next available groove. By periodically noting the vacant space within the bottle the mother can manually reduce the size (length) of the bottle to minimize the vacant space and thereby prevent a vacuum condition from developing within the bottle.

THE DRAWINGS

DESCRIPTION OF A PREFERRED EMBODIMENT OF THE INVENTION

Figure 1:
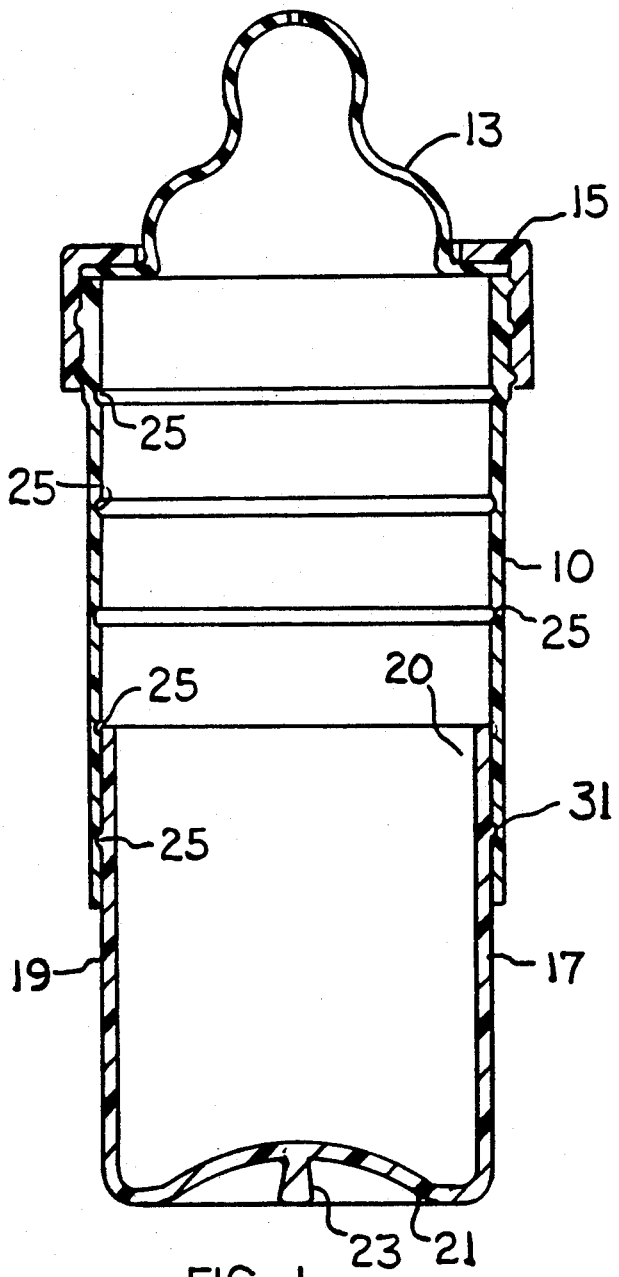
FIG. 1 is a sectional view taken through a nursing bottle embodying the present invention.

The drawings show a nursing bottle that includes a tubular cylindrical sleeve 10 having a nipple 13 releasably secured to one of its ends by means of an annular cap 15. Mating threads are formed on the cap and sleeve to clamp nipple 13 to the sleeve.

Slidably telescoped into sleeve 10 is a cup-shaped liner 17. The liner includes an annular cylindrical side wall 19 and an end wall 21 closing the lower end of wall 19; a handle 23 can be formed on wall 19 to facilitate manual movement of the liner into or out of sleeve 10. Both the sleeve and liner are formed of transparent plastic materials.

At axially spaced points along its length, sleeve 10 has circumferential grooves 25 formed in its inner surface. The drawings show five grooves 25, but a different number of grooves could be used. Preferably there are at least three such grooves spaced essentially equidistantly from each other along the length of sleeve 10.

Figure 2:
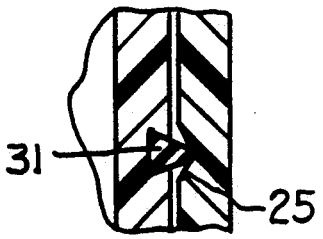
FIG. 2 is a fragmentary enlarged sectional view illustrating a structural detail utilized in the FIG. 1 nursing bottle.

An annular circumferential rib 31 is formed on side wall 19 of liner 17 near its open mouth 20. The rib is designed to have snap fit engagement with any one of the five grooves in sleeve 10. As shown in FIG. 2, rib 31 may be formed of an elastomeric resilient material with a V-shaped cross section. The resilient rib is securely attached to the liner side wall 19, either by molding the rib onto the wall or adhesively bonding the rib to the liner side wall. To enhance the connection between the rib and the liner side wall an endless circumferential channel may be formed in the liner side wall surface; resilient rib 31 is seated within the channel so that only a portion of the rib projects outwardly beyond the outer surface of the liner side wall.

Resilient rib 31 is compressible such that liner 17 can be moved into or out of sleeve 10 with relatively slight frictional resistance from rib 31. As the rib reaches any one of grooves 25 it expands into the groove to have sealing engagement with the groove surface. Each groove can have a V-cross section, with a slightly greater divergence of the legs of the V than the divergence of the V surfaces on rib 31. The tip of the V rib is compressed by contract with the V-shaped groove, such that the rib tends to be centered in the V groove with a snap fit against the groove surface. The cup-shaped liner 17 will thereby be releaseably retained in any of five selected positions of axial adjustment in sleeve 10.

In use of the bottle, cap 15 and nipple 13 are removed to add liquid formula into the bottle. After replacement of the nipple and cap 15, liner 17 is then adjusted upwardly into sleeve 10 until the liquid level is as close as possible to nipple 13 (with minimum vacant air space in the bottle). While the baby is in the process of sucking the liquid out of the bottle the mother periodically observes the liquid level; when the liquid level drops to about the first (uppermost) groove 25 she adjusts the cup-shaped liner 17 upwardly in sleeve 10 until resilient rib 31 snaps into the next groove 25. This action reduces or minimized vacant space within the bottle , thereby preventing a vacuum from forming in the bottle.

The cup shaped liner tends to keep the bottle in a near-full condition at all times, such that the space circumscribed by nipple 13 is always liquid-filled (even when the bottle is only partially overturned). The baby-feeding process is thereby made easier for the mother and for the baby.

I claim:

1. A variable size nursing bottle, comprising a tubular sleeve having first and second ends; a liquid dispensing nipple extending from said first end of the sleeve, the second end of the sleeve being open; at least three circumferential grooves formed in the inner surface of said sleeve at axially spaced points therealong; a cup-shaped liner having an annular side wall, a closed end wall and an open mouth; said liner having a circumferential rib projecting from the outer surface of its annular side wall near its open mouth; said liner being dimensioned to be slidably telescoped into the sleeve, with the open mouth of the liner being relatively close to the nipple, and the end wall of the liner being relatively remote from the nipple; said circumferential rib being dimensioned to have a snap fit in fluid tight relationship within any one of the grooves in the sleeve, whereby the liner can have selected positions of axial adjustment in the sleeve so as to vary the volumetric capacity of the bottle and minimize the possibility of a vacuum forming in the bottle as the baby consumes liquid form the bottle.

2. The bottle of claim 1 wherein said circumferential rib is a resilient rib having a V-shaped cross section; said rib projecting from the outer surface of the liner side wall for sealing engagement with any of the groove surfaces.

* * * * *